US006282810B1

(12) United States Patent
Hsieh

(10) Patent No.: US 6,282,810 B1
(45) Date of Patent: Sep. 4, 2001

(54) METHOD FOR DEHYDRATING WOODEN MATERIAL

(76) Inventor: Te-Ming Hsieh, No. 156, Chung-Shan Road, Taichung Hsien (TW)

( * ) Notice: Subject to any disclaimer, the term of this patent is extended or adjusted under 35 U.S.C. 154(b) by 0 days.

(21) Appl. No.: 09/753,821

(22) Filed: Jan. 4, 2001

(51) Int. Cl.[7] ..... F26B 7/00
(52) U.S. Cl. ..... 34/391
(58) Field of Search ..... 34/391, 381, 389, 34/393, 394, 396, 423

(56) References Cited

U.S. PATENT DOCUMENTS 3,713,943 * 1/1973 Huff ..... 156/255
4,027,401 * 6/1977 Fairbanks, Jr. ..... 34/16.5
4,466,198 * 8/1984 Doll ..... 34/1
5,612,094 * 3/1997 Schuber et al. ..... 427/397
5,612,142 * 3/1997 Lewis ..... 428/528
5,665,432 * 9/1997 Kuwazuru et al. ..... 427/325
5,731,036 * 3/1998 Battershell et al. ..... 427/297
5,970,624 * 10/1999 Moriya ..... 34/411
6,183,812 * 2/2001 Hellgren ..... 427/325
6,217,939 * 4/2001 Sailer et al. ..... 427/325

* cited by examiner

*Primary Examiner*—Teresa Walberg
*Assistant Examiner*—Vinod D Patel
(74) *Attorney, Agent, or Firm*—Charles E. Baxley

(57) ABSTRACT

A method for dehydrating wooden material includes step 1 to cut wooden material into sections; step 2 to soak the wooden material in oil and to heat the oil; step 3 to soak the wooden material in step 2 in boiling water to resolve the gluey material in the wooden material; step 4 to cool the wooden material in step 3; step 5 to remove gluey particles on surface of the wooden material, and step 6 to dry the wooden material in step 5.

2 Claims, 2 Drawing Sheets

METHOD FOR DEHYDRATING WOODEN MATERIAL

FIELD OF THE INVENTION

The present invention relates to a method for accelerating dehydration of wooden material.

BACKGROUND OF THE INVENTION

A conventional process of dehydration for wooden material such as logs or bamboo is to collect the logs or bamboo in a cool and dry area to let the moisture in the wooden material release naturally. This conventional method takes a long time and requires a large area for the wooden material. During the process of dehydration, damage due to insects or nature disasters could happen and results lost to the wood merchants. The long waiting period cannot meet needs of markets and the wooden products could deform if the dehydration process is not completely proceeded. As shown in FIG. 1, when the cambium is transferred to xylem, the conduits 111 and fibers 112 of the wood become the main passages for the moisture 13 to release from the wood. Nevertheless, there is gluey particles 12 located in the conduits 111 and the gluey particles 12 stock the conduits 111 so that moisture 13 cannot release. Therefore, the waiting period will be prolonged.

The present invention intends to provide a method that effectively shortens the period for dehydrating the wooden material.

SUMMARY OF THE INVENTION

In accordance with one aspect of the present invention, there is provided a method for dehydrating wooden material and including step 1 to cut wooden material into sections; step 2 to soak the wooden material in oil and to heat the oil; step 3 to soak the wooden material in step 2 in boiling water to resolve the gluey material in the wooden material; step 4 to cool the wooden material in step 3; step 5 to remove gluey particles on surface of the wooden material, and step 6 to dry the wooden material in step 5.

The primary object of the present invention is to provide a method that shortens the period for dehydrating wooden material.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
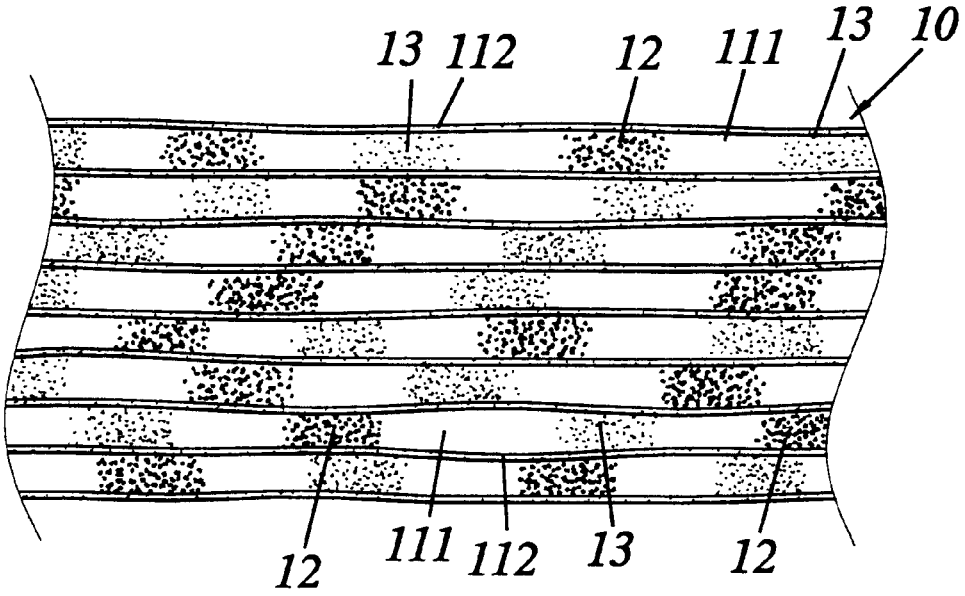
FIG. 1 PRIOR ART
FIG. 1 is cross sectional view of prior art to show moisture and gluey particles in wooden material.
Figure 2:
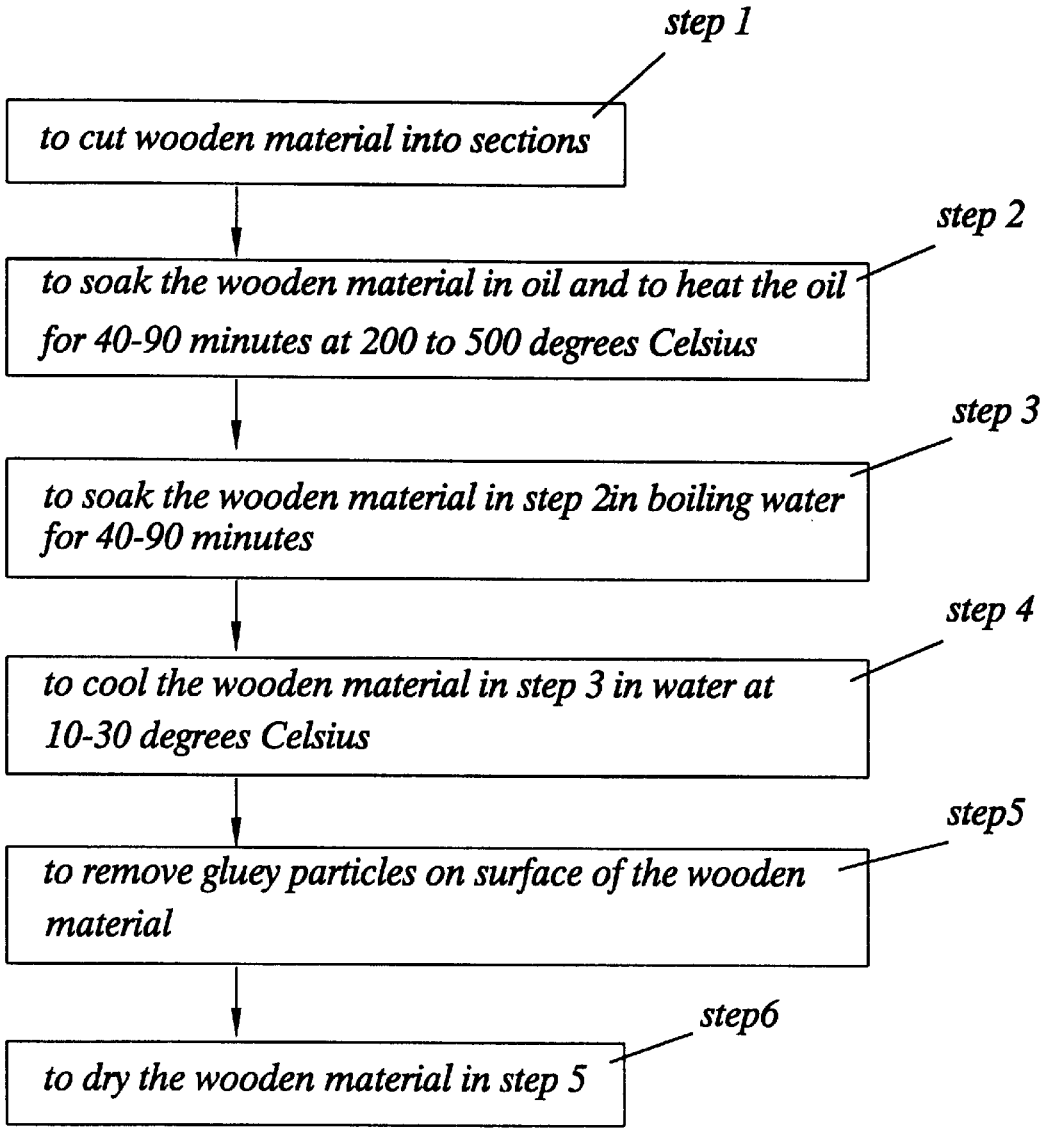
FIG. 2 is a flow chart to show the steps of the method for dehydrating wooden material of the present invention.

Referring to FIG. 2, the method for dehydrating wooden material of the present invention comprises the following steps:

step 1: to cut wooden material into sections;

step 2: to soak the wooden material in oil and to heat the oil for 40–90 minutes at 200 to 500 degrees Celsius to soften the gluey particles and evaporate moisture in the wooden material;

step 3: to soak the wooden material in step 2 in boiling water for 40–90 minutes to dissolve the gluey particles and expel the gluey particles from the conduits of the wooden material and the conduits are not stocked;

step 4: to cool the wooden material in step 3 in water at 10–35 degrees Celsius to control the extent of deformation of the wooden material;

step 5: to remove gluey particles on surface of the wooden material, and step 6: to dry the wooden material in step 5.

It is to be noted that anti-insect material such as slat or lime powder may be used in the water in step 3. In step 2, the oil will not enter into the conduits after the wooden material is heated in the oil. The processed wooden material can be completely dehydrated after 80 to 120 hours in nature status and only takes 4–24 hours if using fans to accelerate the release rate of the moisture in the wooden material.

While we have shown and described various embodiments in accordance with the present invention, it should be clear to those skilled in the art that further embodiments may be made without departing from the scope and spirit of the present invention.

What is claimed is:

1. A method for dehydrating wooden material comprising the following steps:

step 1: cutting wooden material into sections;

step 2: soaking the wooden material in oil at 200 to 500 degrees Celsius; for 40–90 minutes;

step 3: soaking the wooden material in step 2 in boiling water for 40–90 minutes;

step 4: cooling the wooden material in step 3 in water at 10–35 degrees Celsius;

step 5: removing gluey particles on surface of the wooden material, and step 6: drying the wooden material in step 5.

2. The method as claimed in claim 1 further providing anti-insect material in the water in step 3.

* * * * *